US012440748B2

(12) United States Patent
McAfee

(10) Patent No.: US 12,440,748 B2
(45) Date of Patent: Oct. 14, 2025

(54) MODULAR SPORT COURT

(71) Applicant: Sam McAfee, Santa Monica, CA (US)

(72) Inventor: Sam McAfee, Santa Monica, CA (US)

( * ) Notice: Subject to any disclaimer, the term of this patent is extended or adjusted under 35 U.S.C. 154(b) by 0 days.

(21) Appl. No.: 18/965,983

(22) Filed: Dec. 2, 2024

(65) Prior Publication Data

US 2025/0177845 A1 Jun. 5, 2025

Related U.S. Application Data

(60) Provisional application No. 63/605,466, filed on Dec. 1, 2023.

(51) Int. Cl.
*A63C 19/06* (2006.01)

(52) U.S. Cl.
CPC ..... *A63C 19/06* (2013.01)

(58) Field of Classification Search
CPC ..... A63C 19/06
USPC ..... 472/92
See application file for complete search history.

(56) References Cited

U.S. PATENT DOCUMENTS

| | | | |
|---|---|---|---|
| 2008/0053018 | A1 | 3/2008 | Hockemeyer |
| 2010/0263296 | A1 | 10/2010 | Jones |
| 2012/0291369 | A1 | 11/2012 | Knight et al. |
| 2024/0299817 | A1 | 9/2024 | Schmidt |

FOREIGN PATENT DOCUMENTS

| | | | | |
|---|---|---|---|---|
| CN | 104264936 | | 1/2015 | |
| CN | 210947557 | | 7/2020 | |
| CN | 214117654 | * | 9/2021 | |
| CN | 115287972 | * | 11/2022 | ..... E01C 13/04 |
| WO | WO 2019/213439 | * | 11/2019 | ..... G06Q 50/10 |

* cited by examiner

*Primary Examiner* — Jerome Grant, II
(74) *Attorney, Agent, or Firm* — Cislo & Thomas, LLP

(57) ABSTRACT

A playing court apparatus for facilitating playing of a game having a base assembly configured to be disposed on any type of ground surface using a leveling foundation. The base assembly includes a plurality of base units that can be interconnected in a modular manner to support a playing surface. The base units are made from a variety of layers configured to improve the structural integrity of the playing surface and provide enhanced features. The playing surface is made from a plurality of surface panels modularly connected to each other. The surface panels are also made from a variety of layers to improve the functionality of the surface. The leveling foundation utilizes a plurality of legs to support the base units. For a complete, all encompassing playing court, the playing court can further have a netting system, a fencing system, and a lighting system.

20 Claims, 13 Drawing Sheets

MODULAR SPORT COURT

CROSS-REFERENCE TO RELATED APPLICATION

This patent application claims the benefit of U.S. Provisional Patent Application Ser. No. 63/605,466, entitled "A Playing Court Apparatus for Facilitating Playing of a Game," filed Dec. 1, 2023, which application is incorporated in its entirety here by this reference.

FIELD OF THE INVENTION

The present invention relates generally to games or sports accessories. More specifically, the present invention is a playing court apparatus for facilitating playing of a game.

BACKGROUND OF THE INVENTION

The field of games or sports accessories is technologically important to several industries, business organizations, and/or individuals. Current court surfaces are applied over level existing surfaces by being rolled out or clicked together tile. The actual issue with most courts is creating a new level and flat foundation on which to place the court. There is a Padel apparatus that uses an off-the-shelf deck leveling system with steel members and ceramic tiles that are then covered with a carpet for a play surface, but this court system is not appropriate for pickleball. Further, permanent infrastructure requires a permit, whereas temporary systems do not (but may require a safety inspection). There are no temporary foundation systems for pickleball courts available. If a non-permanent solution was available, then many more location options would be available for court installation.

In addition, most of the best parking surface locations are tied up in existing leases. Nearly all existing or potential exterior locations that can be converted to pickleball court play have a slope that is incorrect for existing roll-out or tiled court surface systems.

Also, current courts lack features to improve game play. As more and more players flood into the game or sport, line-calling accuracy is beginning to influence the outcome of matches. Current courts do not include a smart court surface that can call shots in or out. Current courts on the market do not provide ball contact locations.

Furthermore, not all locations have access to power. Providing power requires permits and time. Current courts do not provide all the components for a complete tournament-ready club court anywhere. Existing lighting solutions are on the market for parking. Current portable or energy independent court lighting for pickleball does not provide a unique light temperature, height, spread, and lumens profile.

Finally, permanent courts wear out and the components cannot be repaired individually or cheaply. Current courts do not allow for the repair, replacement, or upgrade of any component. Tiled surfaces also have this potential, but tiled surfaces are not tournament-sanctioned and do not play the same as a sanded acrylic surface.

Lack of pickleball court availability due to overcrowding, the increasing cost and time it takes to build a new pickleball court, along with the limited locations where pickleball courts can be installed due to permitting issues and noise, is leading to overcrowding and inhibiting the growth of the sport. Additionally, play surface inconsistency between different pickleball court locations due to differing install material/techniques/quality, night play lighting inconsistencies, and line calling disagreements due to the ball's speed and the difficulty to see where it bounces leading to reduced quality of play.

Therefore, there is a need for an improved playing court that may overcome one or more of the above-mentioned problems and/or limitations.

SUMMARY OF THE INVENTION

This summary is provided to introduce a selection of concepts in a simplified form, that are further described below in the Detailed Description. This summary is not intended to identify key features or essential features of the claimed subject matter. Nor is this summary intended to be used to limit the claimed subject matter's scope.

According to some embodiments, disclosed herein is a playing court apparatus for facilitating playing of a game. Accordingly, the playing court apparatus may include a base assembly configured to be disposed on at least one ground surface. Further, the base assembly may include a plurality of base units. The plurality of base units may be modularly connected. Each of the plurality of base units may include a top portion and a plurality of legs attached to the top portion and extending from a bottom side of the top portion. Further, the top portion may be comprised of at least one sound absorbing material. Each of the plurality of legs may include a height adjusting mechanism. The height adjusting mechanism may be configured for adjusting a height of each of the plurality of legs.

In addition, the playing court apparatus may include a plurality of surface panels that defines a playing surface. The surface panels may be removably attached on a top side of the top portion of the plurality of base units. The plurality of surface panels may be modularly connected to each other.

The foundation cells include sound reduction design characteristics to absorb and prevent sound transmission. These include: sound absorbing interim layers, additional sound absorbing material applied to the underside of the foundation cell, integration of sound absorption characteristics into the upper sports surface performance layers, and any combination thereof.

Further, the playing court apparatus may include a fencing assembly configured to be removably coupled with the base assembly, and disposed around a periphery of the base assembly. The playing court apparatus may further include a lighting assembly configured to be removably coupled with the base assembly in at least one location along the periphery of the base assembly. Further, the playing court apparatus may include a net assembly configured to be removably attached to the base.

The playing court apparatus may include a plurality of sensors configured to be integrated with the plurality of surface panels. The plurality of sensors may be configured for generating a signal indicating a position of a ball hitting the playing surface. The playing court apparatus may include a plurality of power generating devices integrated with the plurality of surface panels. Further, the plurality of power generating devices may be configured for generating and/or harvesting electrical power, such as a photovoltaic panel. The plurality of power generating devices may be electrically coupled with a lighting device of the lighting assembly. Further, the plurality of power generating devices may be configured for powering the lighting device of the lighting assembly.

Each foundation component is designed so that it is not too heavy or so large that one person of regular strength and size cannot lift or move it. The foundation parts fit together in a way as to align and secures the top surface in a flush and level manner with tight seams that prevent movement along all axes at all connections. Connections can be designed to be hidden on the top surface. Connections can be made in a way that the system can be disassembled and reassembled as many times as desired without damage to the system or need to replace parts. Each part of the foundation system can be repaired or replaced independently without the need to replace the entire system.

Both the foregoing summary and the following detailed description provide examples and are explanatory only. Accordingly, the foregoing summary and the following detailed description should not be considered to be restrictive. Further, features or variations may be provided in addition to those set forth herein. For example, embodiments may be directed to various feature combinations and sub-combinations described in the detailed description.

BRIEF DESCRIPTION OF THE DRAWINGS

The accompanying drawings, which are incorporated in and constitute a part of this disclosure, illustrate various embodiments of the present disclosure.

DETAIL DESCRIPTIONS OF THE INVENTION

Figure 1:
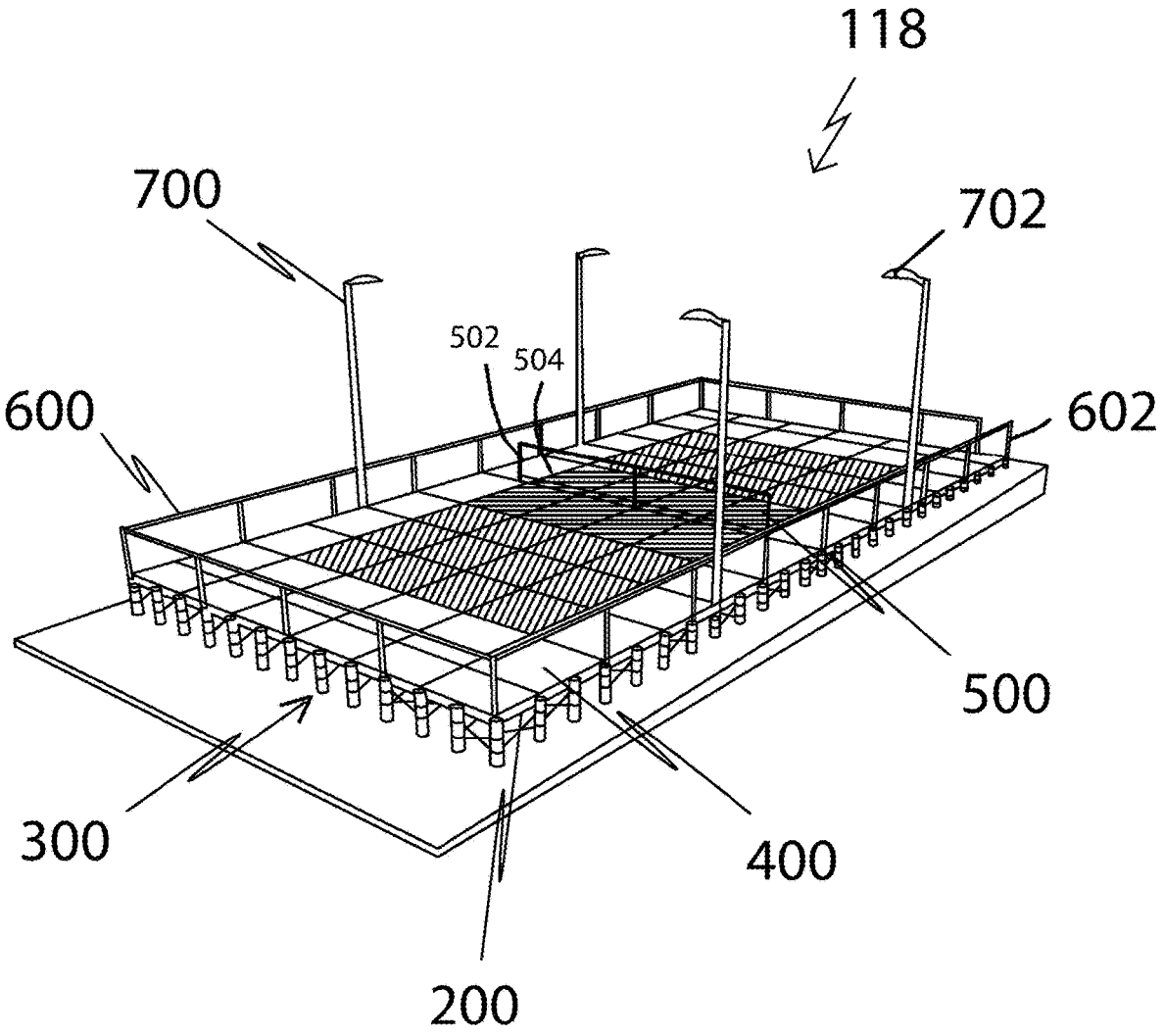
FIG. 1 is a schematic of a playing court apparatus for facilitating playing of a game, in accordance with some embodiments.

As a preliminary matter, it will readily be understood by one having ordinary skill in the relevant art that the present disclosure has broad utility and application. As should be understood, any embodiment may incorporate only one or a plurality of the above-disclosed aspects of the disclosure and may further incorporate only one or a plurality of the above-disclosed features. Furthermore, any embodiment discussed and identified as being "preferred" is considered to be part of a best mode contemplated for carrying out the embodiments of the present disclosure. Other embodiments also may be discussed for additional illustrative purposes in providing a full and enabling disclosure. Moreover, many embodiments, such as adaptations, variations, modifications, and equivalent arrangements, will be implicitly disclosed by the embodiments described herein and fall within the scope of the present disclosure.

Accordingly, while embodiments are described herein in detail in relation to one or more embodiments, it is to be understood that this disclosure is illustrative and exemplary of the present disclosure, and are made merely for the purposes of providing a full and enabling disclosure. The detailed disclosure herein of one or more embodiments is not intended, nor is to be construed, to limit the scope of patent protection afforded in any claim of a patent issuing here from, which scope is to be defined by the claims and the equivalents thereof. It is not intended that the scope of patent protection be defined by reading into any claim a limitation found herein that does not explicitly appear in the claim itself.

Thus, for example, any sequence(s) and/or temporal order of steps of various processes or methods that are described herein are illustrative and not restrictive. Accordingly, it should be understood that, although steps of various processes or methods may be shown and described as being in a sequence or temporal order, the steps of any such processes or methods are not limited to being carried out in any particular sequence or order, absent an indication otherwise. Indeed, the steps in such processes or methods generally may be carried out in various different sequences and orders while still falling within the scope of the present invention. Accordingly, it is intended that the scope of patent protection is to be defined by the issued claim(s) rather than the description set forth herein.

Additionally, it is important to note that each term used herein refers to that which an ordinary artisan would understand such term to mean based on the contextual use of such term herein. To the extent that the meaning of a term used herein—as understood by the ordinary artisan based on the contextual use of such term-differs in any way from any particular dictionary definition of such term, it is intended that the meaning of the term as understood by the ordinary artisan should prevail.

Furthermore, it is important to note that, as used herein, "a" and "an" each generally denotes "at least one," but does not exclude a plurality unless the contextual use dictates otherwise. When used herein to join a list of items, "or" denotes "at least one of the items," but does not exclude a plurality of items of the list. Finally, when used herein to join a list of items, "and" denotes "all of the items of the list."

The following detailed description refers to the accompanying drawings. Wherever possible, the same reference numbers are used in the drawings and the following description to refer to the same or similar elements. While many embodiments of the disclosure may be described, modifications, adaptations, and other implementations are possible. For example, substitutions, additions, or modifications may be made to the elements illustrated in the drawings, and the methods described herein may be modified by substituting, reordering, or adding stages to the disclosed methods. Accordingly, the following detailed description does not limit the disclosure. Instead, the proper scope of the disclosure is defined by the appended claims. The present disclosure contains headers. It should be understood that these headers are used as references and are not to be construed as limiting upon the subjected matter disclosed under the header.

The present disclosure includes many aspects and features. Moreover, while many aspects and features relate to, and are described in the context of, a playing court apparatus for facilitating playing of a game, embodiments of the present disclosure are not limited to use only in this context.

Overview

FIG. 1 is a schematic of a playing court 118 for facilitating playing of a game, in accordance with the embodiments of the present invention. The court 118 may include all-in-one, non-permanent, tournament-ready, modular prefab foundation and sport court comprising one or more of a base assembly 200 configured to be disposed on at least one ground surface, a leveling foundation pier system 300, professional-grade play surface 400 with smart court sensor ball contact detection and location illumination technology, an integrated court net system 500, a safety perimeter fencing system 600, and a lighting system 700. The efficiency of the assembly and disassembly arises from the use of structural cells that can be interconnected together. The structural cell can comprise a base unit 204 and one or more legs 302 attached thereto that can be connected together to form the base assembly 200 and leveling foundation pier system 300. Once the base assembly 200 and leveling foundation pier system 300 are assembled, the additional features can be added on.

The playing court 118 may be designed for a four-season installation on any type of sub-surface, prepared or unprepared, level, flat, and sloped, for temporary or long-term use; and made to be easily disassembled for repair, upgrade, storage, or moved to a new location. Because of the pier system 300, the surface on which this playing court 118 can be installed does not need to be flat or consistent in elevation. For example, the playing court 118 can be installed on sand, dirt, gravel, grass, mud, paved, planted, and the like.

Due to the modularity, the playing court 118 apparatus may provide a non-permanent court solution that may open up in locations such as parking spaces for pickleball development under short-term lease agreements with options to renew. This is due to the lack of permitting or permanent alteration of the existing property, which would require the renegotiation of the original lease. As such, the playing court 118 may include a modular, non-permanent all-in-one court system that allows for court installation without the typically required permits when installing permanent infrastructure.

Also, the playing court 118 reduces the total construction costs to well below typical while allowing the customer to keep the value of the court infrastructure by allowing 100 percent of all elements to be resold or moved to another location if the current site is no longer available for court usage. In conventional installations, most costs for court infrastructure would be lost and abandoned to the site if moved. The playing court 118, however, reduces the total site construction time from months to one day. Many optimal locations like parking lots, especially in urban environments, are tied up in long term business leases that do not allow for permanent permitted court construction.

Further, the disclosed modular, non-permanent playing court 118 is easily disassembled, thereby allowing for unpermitted installation in locations where a permit cannot be issued to install permanent infrastructure. This approach opens up many locations that are tied up by long-term commercial leases that would require to be renegotiated if permanent alteration was needed to be made to the leased property. The disclosed playing court 118 allows for short-term no-conflicting leases on already leased property.

Additionally, most potential new locations are undeveloped or have a slope that will not allow for a court to be constructed without permanent regrading or structural alterations. The disclosed playing court 118 solves installation problems anywhere by not requiring any prior site preparation to accommodate the court installation. The disclosed playing court 118 apparatus may be installed in any location that is large enough in width and length and of firm or solid earth.

For noisy sports like pickleball, the best court locations are usually far away from residential housing and power sources. The disclosed playing court 118 solves this issue by allowing for installation on any undeveloped area and including an off-grid all-in-one lighting solution to completely remove the need for construction permits. In addition, the court may allow for the implementation of this technology in its repairable and modularly installed surface. In other words, repair or replacement of parts of the playing court 118 is greatly facilitated because the repair or replacement can be performed one cell at a time. As such portions of the playing court 118 that are fully functional need not be damaged in order to repair or replace a damaged portion.

Further, the disclosed court allows for a controlled and consistent factory-manufactured, professionally certified system to be provided that is easily maintainable and replaceable. This is in contrast to the norm, which is a highly inconsistent site-built court by trades who do not possess the specialty knowledge to design, source the proper materials, and install a quality lasting court. Low quality court installations and high usage lead to worn-out or damaged court surfaces, when left unrepaired leading to increased injury and poor play quality. Currently, when a court is worn out, the entire court must be resurfaced. By contrast, the disclosed playing court 118 is easily disassembled, repaired, or individual portions, replaced.

Online Platform

Figure 2:
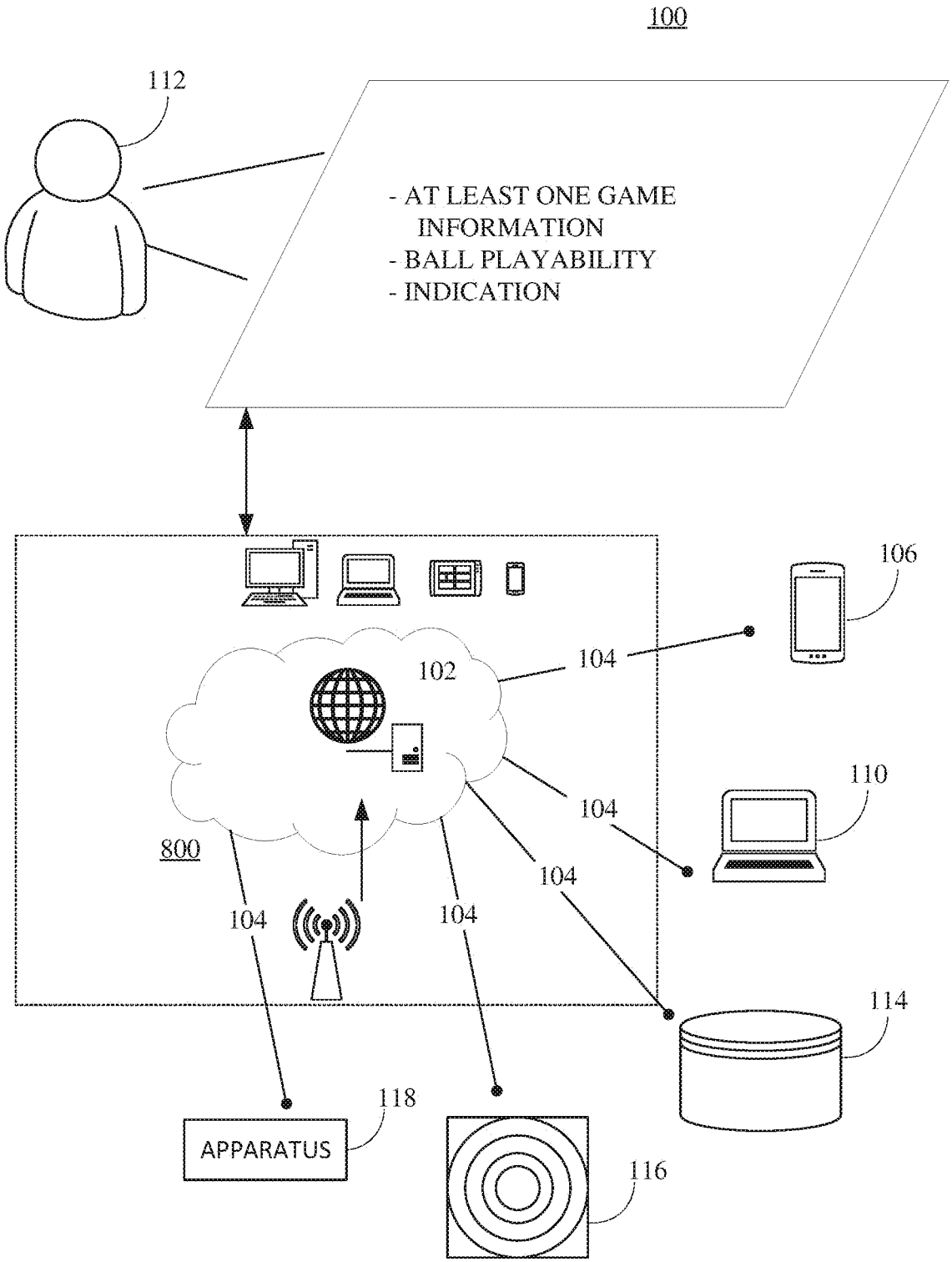
FIG. 2 is an illustration of an online platform consistent with various embodiments of the present disclosure.

FIG. 2 is an illustration of an online platform 100 consistent with various embodiments of the present disclosure. By way of non-limiting example, the online platform 100 for facilitating playing of a game using a playing court 118 that may be hosted on a centralized server 102, such as, for example, a cloud computing service. The centralized server 102 may communicate with other network entities, such as, for example, a mobile device 106 (such as a smartphone, a laptop, a tablet computer, etc.), other electronic devices 110 (such as desktop computers, server computers, etc.), databases 114, sensors 116, and the playing court 118 over a communication network 104, such as, but not limited to, the Internet. Further, users of the online platform 100 may include relevant parties such as, but not limited to, end-users, service providers, and administrators. Accordingly, in some instances, electronic devices operated by the one or more relevant parties may be in communication with the online platform 100.

A user 112, such as the one or more relevant parties, may access the online platform 100 through a web-based software application or browser. The web-based software application may be embodied as, for example, but not be limited to, a website, a web application, a desktop application, and a mobile application compatible with a computing device 800.

Base Assembly

Figure 3:
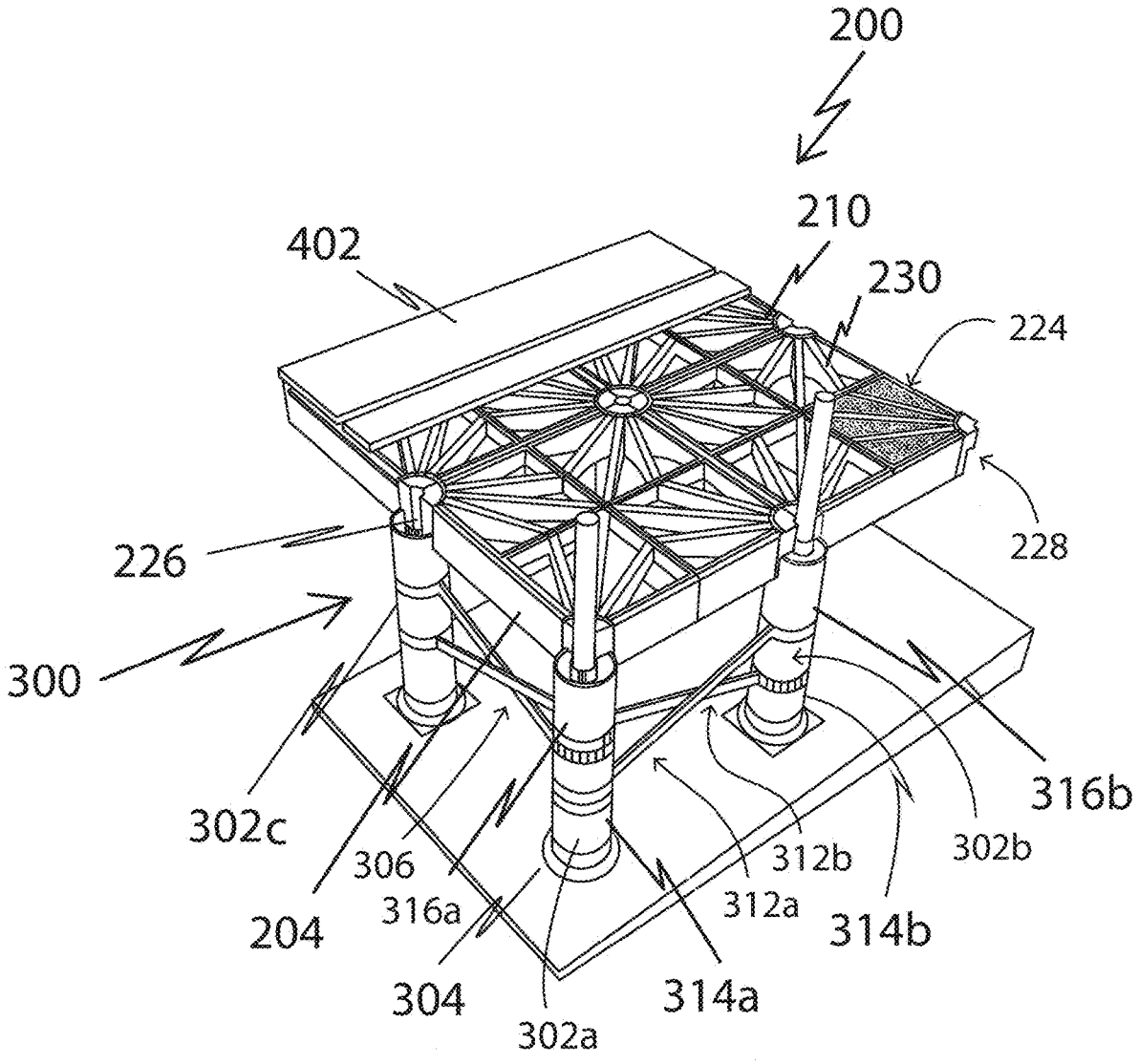
FIG. 3 illustrates a portion of the base assembly for facilitating playing the game, in accordance with some embodiments.

With reference to FIG. 3, the base assembly 200 is formed by connecting a plurality of structural cells together. A structural cell 202 can be comprised of a base unit 204 and at least one leg 302. The plurality of base units 204 can be configured to be modularly connected to each other like a plurality of interlocking structural pavers. The plurality of interlocking base units 204 may be characterized by geometrical a shape (such as a circle, triangle, rectangle, parallelogram, hexagon, octagon, and the like). Preferably, the geometric shape of the base unit 204 allows for interconnections with each other forming minimal gaps.

Figure 4:
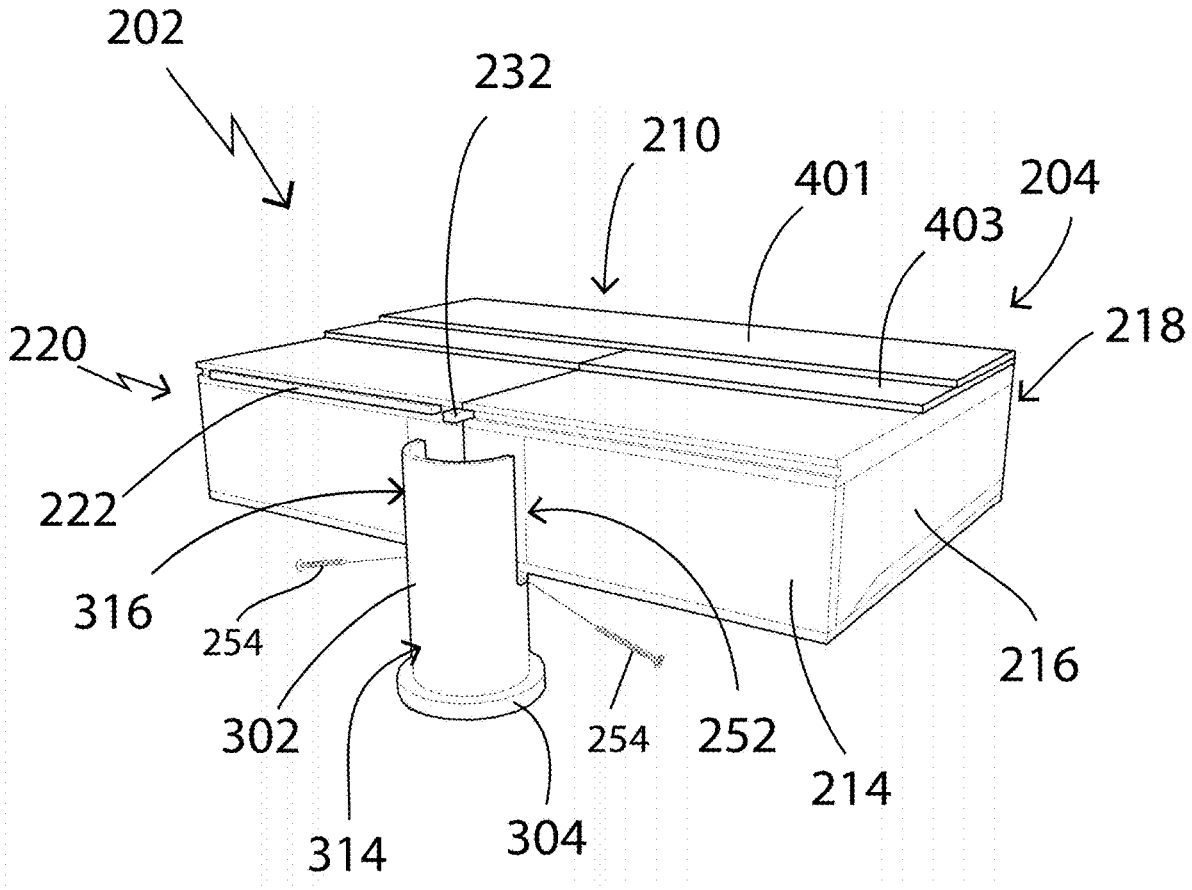
FIG. 4 illustrates a portion of the structural cell for facilitating playing the game, in accordance with some embodiments.
Figure 5:
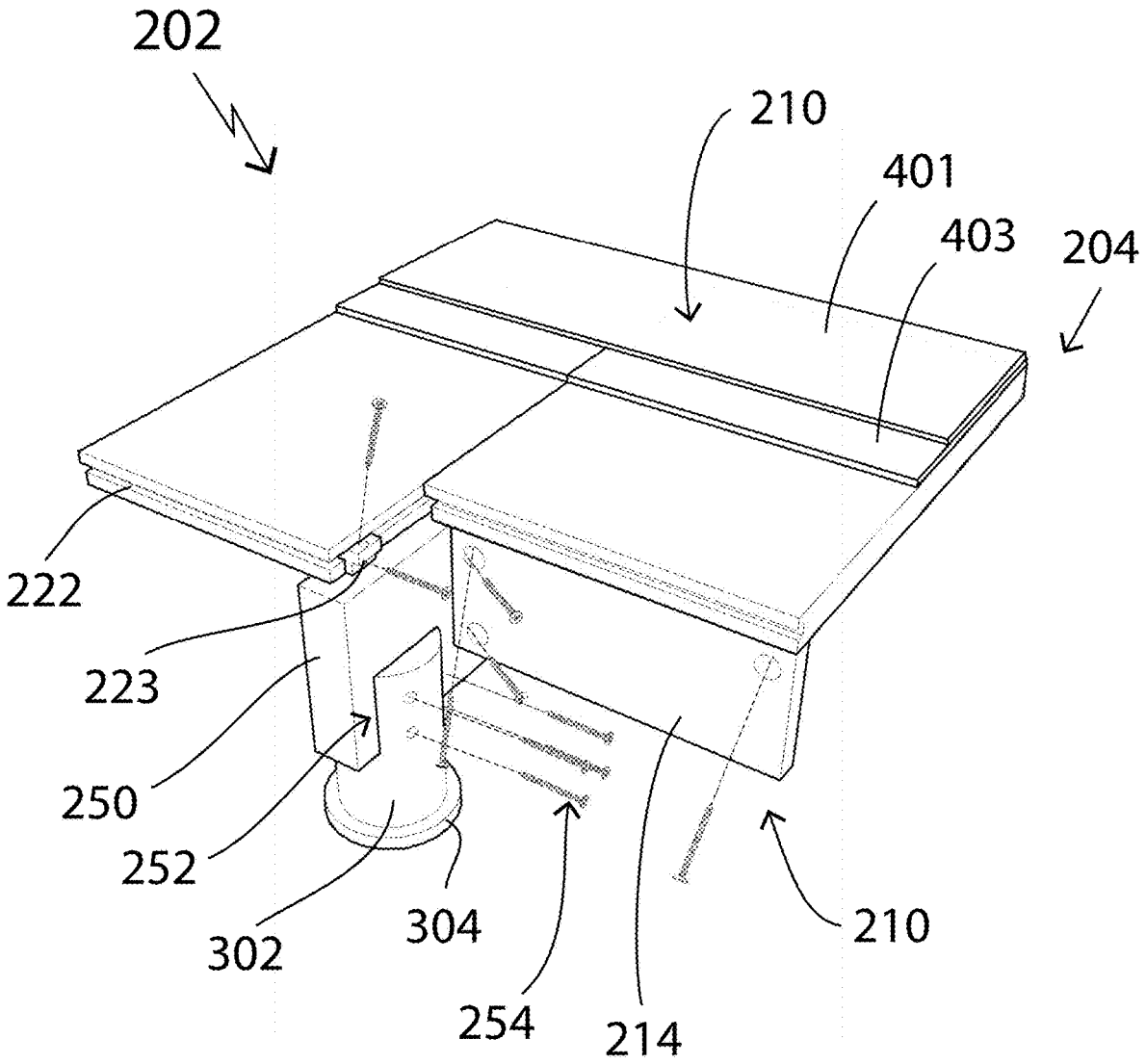
FIG. 5 illustrates a portion of another embodiment of the structural cell for facilitating playing the game, in accordance with some embodiments.
Figure 6:
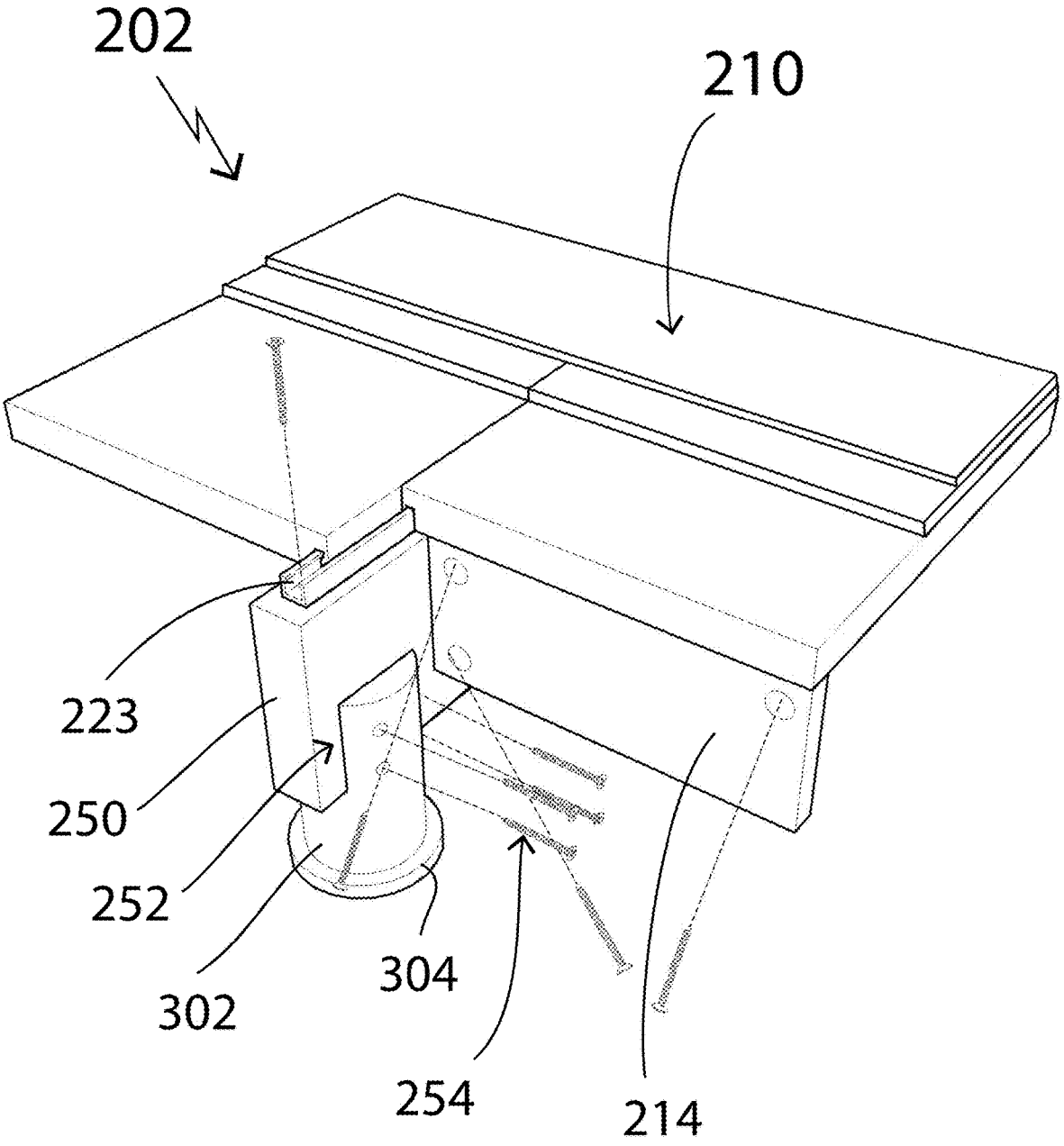
FIG. 6 illustrates a portion of another embodiment of the structural cell for facilitating playing the game, in accordance with some embodiments.

With reference to FIGS. 4-6, each of the plurality of base units 204 comprises a top side 210 and a bottom side 212 opposite the top side 210, and a plurality of sidewalls 214, 216, 218, 220. Each sidewall 214, 216, 218, 220 can comprise a connector 222 configured to connect adjacent base units 204 together. For example, the connector 222 can use a tongue-and-groove system, dovetail joints, dowel joints, clips, adhesives, screws, nuts and bolts, and the like. As such, the plurality of base units 204 can be connected together to form a structural cell grid system. A spline 232 can be used to align top sides 210 of the base units 204. The spline 232 can project outwardly from one or more of the sidewalls 214, 216, 218, 220 to interconnect with an adjacent base unit 204. When the base units 204 are aligned by the splines 232 the top sides 210 can be aligned for a smooth continuous surface.

Figure 7:
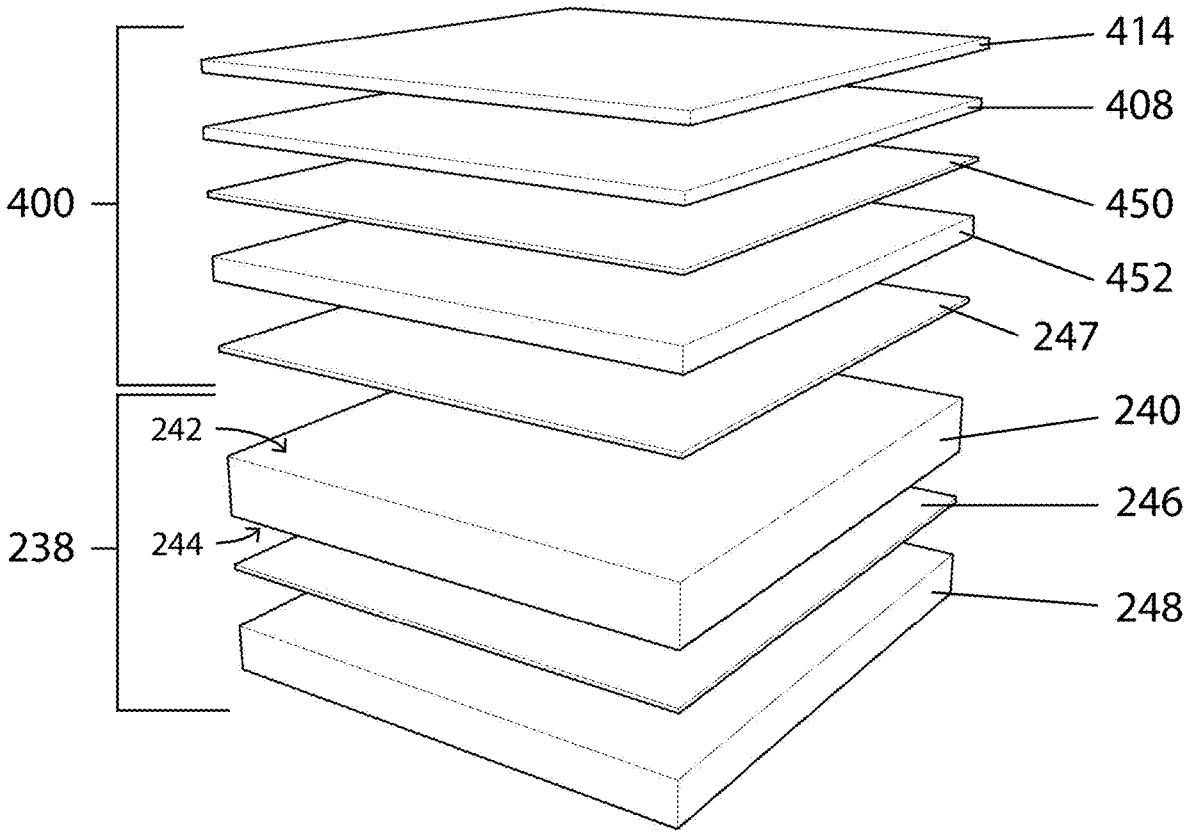
FIG. 7 is an exploded view of the surface panels and foundational layers, in accordance with some embodiments.

With reference to FIG. 7, the base unit 204 can be comprised of a multi-layer system to customize the playing surface according to sport, weather, environment, and the like. The base unit 204 is comprised of a foundation 238 that provides structural integrity to the base unit 204. The foundation 238 comprises a structural core 240 having a top surface 242 and a bottom surface 244 opposite the top surface 242. By way of example only, the structural core 240 can be made from lightweight gypsum, lightweight concrete, foam-crete, lightweight plant fiber, cellular-based core material (e.g., foam, corrugated cardboard, etc.), and the like, and in any combination thereof. In some embodiments, the structural core 240 can have a reinforced layer on the top and bottom surfaces 242, 244 of the structural core 240 using fiberglass, hardwood, composite, plastic, resin infused paper, mesh, and the like. In the preferred embodiment, the connector 222 can be created in the structural core 240 to allow base units 204 to connect together.

In some embodiments, the foundation 238 may further comprise a water proof layer 246. The waterproof layer 246 can comprise acrylic, silicone, or polyurethane paint; phenolic resin paper; epoxy; adhered plastic sheet; fiberglass sheet; polyurethane glue; polyester/vinylester gelcoat; rubber sheet, and the like. Preferably, the water proof layer 246 is attached to the bottom surface 244 of the structural core 240. In some embodiments, a second water proof layer 247 can be applied on top of the structural core 240. In some embodiments, the foundation 238 can further comprise a sound insulating layer 248. The sound insulating layer 248 can be made from lightweight plastic, fiberglass, metal, paper, wood, and the like.

Preferably, the sound insulating layer 248 is attached to the bottom surface 244 of the structural core 244 or the water proof layer 246 opposite the structural core 240. In some embodiments, the sound insulating layer 248 (or material) can be integrated into the structural core 240.

To facilitate a strong and seamless connection between base units 204, the structural cell 202 may further include a lock 223. The lock 223 can align base units 204 and create a continuous top surface 210 of the structural cell 202. Preferably, the lock 223 can be a snap-in place connection strip, such as a continuous C-channels that can lock onto connectors 222 on the side edge (FIG. 5) or underside edge (FIG. 6) of the structural core 240. In some embodiments, the base unit is connected to the leg 302 via a floor beam 250. In such embodiments, the lock 223 can be fasten the structural core 240 to the floor beam 250. Because the lock 223 is connected to a side edge or underside edge of the structural core 240, the lock 223 provides a hidden fastener system to secure the edges of the base units 204 in a manner so they are tight to each other, held down in place, and align the upper surface of the structural cell 202.

Figure 8:
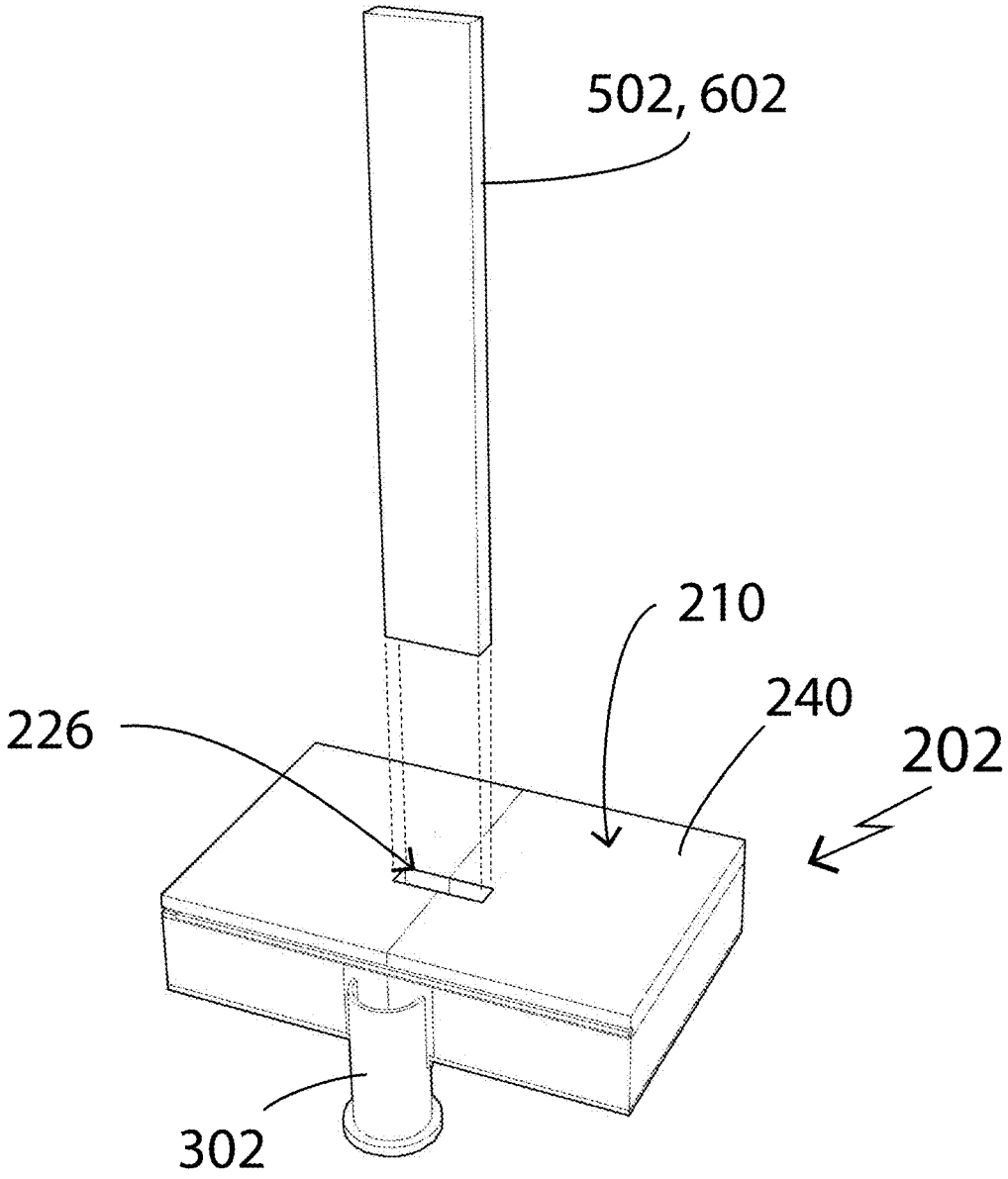
FIG. 8 is an illustration of installment of a post into the base unit, in accordance with some embodiments.

With reference to FIG. 8, the base unit 204 may allow for different posts and structural cell material types to be used in the playing court 118. For example, in some embodiments of the base unit 204, the top side 210 and/or the bottom side 212 can have one or more holes defined therein into which various posts 502, 602 can be inserted. By way of example only, the top side 210 can have one or more top side holes 226 into which posts 502, 602 to hold up fencing, netting, lighting, and the like, along the top side 210 of the court 118. Similarly, the bottom side 212 can have one or more bottom side holes 228 into which legs 302 can be inserted to support and elevate the court 118 as shown in FIG. 3.

In some embodiments, the top side holes 226 can be coaxially aligned with the bottom side holes 228 so that the legs 302 can provide additional foundation and support for the posts 502, 602 for the net 504 and fence 604. Preferably, the top side holes 226 are arranged so that a fencing system 600 can be erected around the periphery of the court 118 to reduce the frequency of, or prevent, unwanted guests, objects, animals, and the like from entering onto the playing court 118.

In some embodiments, the top side holes 226 and bottom side holes 228 are formed at the junction of two or more base units 204. In other words, it can take two or more base units 204 connected together to form a top side hole 226 or a bottom side hole 228. For example, if two base units 204 connected together form a top side hole 226 or a bottom side hole 228, then each base unit 204 forms half of the top side hole 226 or bottom side hole 228. If four base units 204 are required to form a top side hole 226 or a bottom side hole 228, then each base unit 204 forms a quarter of the top side hole 226 or bottom side hole 228. The example shown in FIG. 3 shows base units 204 in the shape of squares. As such, each corner of a base unit 204 forms a quarter circle. When four base units 204 are connected together, then a single top side hole 226 or bottom side hole 228 can be formed into which a post (such as a net post 502, fence post 602, lamp post, a leg 302, and the like) can be inserted.

In some embodiments, the base unit 204 can comprise ribbing 230 to increase the strength, durability, and integrity of the playing court. In the preferred embodiment, a plurality of ribbing 230 can extend from the top side hole 226 or bottom side hole 228 of the base unit 204 and extend radially outwardly therefrom towards the perimeter of the base unit 204 like spokes. As such, when the play surface 400 is placed on top of the base unit 204, the weight of the play surface 400 is distributed across the ribbing 230. As such, the ribbing 230 extends the full height of the base unit 204 so as to be able to bear weight applied on the top surface 210. In some embodiments with sound absorption, the sound absorbing material 224 can be inserted in between the ribbing 230, above the ribbing 230, or below the ribbing 230.

The assembly described herein allows for molded or built up truss assembly with hardened upper surface that spans supporting point loads to transfer the entirety of the weight on the top surface to the supporting structure.

Leveling Foundation

The playing court 118 can further comprise a leveling foundation system 300. The leveling foundation system can be a modular pier system comprising any one or more of the following: legs 302, leveling feet 304, cross bracing 306, and quick connection system 308 to easily connect and disconnect from the base unit 204 and each other. For example, the quick connection system 308 can involve the leg 302 sliding into the bottom side hole 228 of the base unit 204. For added security and stability, the leg 302 can be held inside the bottom side hole 228 via interference fit, threading, bayonet mounts, fasteners (such as screws, bolts, clamps, clips, hooks, tracks, tabs, snap-fit, and the like), magnets, and the like. Accordingly, the base units 204 can slip or slide on top of adjacent legs 302 to align the base units 204 adjacent to each other where the base units 204 can be connected together.

As a result, the legs 302 can extend from the bottom side 212 of the base unit 204. Preferably, the leg 302 may include a height adjusting mechanism. The height adjusting mechanism may be configured for adjusting a height of the leg 302. For example, the height adjusting mechanism 310 can comprise telescoping legs, hydraulic lift, pneumatic lift, electric lift, mechanical lift, and the like. In some embodiments, the height adjusting mechanisms is based on the configuration of the top and bottom ends of the legs 302. Specifically, the bottom of one leg 302 can be configured to stack on top of the top of another leg 302.

To stabilize the legs 302, a cross-bracing system 306 may be provided to connect adjacent legs 302*a*, 302*b* to each other. In the preferred embodiment, a first cross brace 312*a* can connect the bottom portion 314*a* of a first leg 302*a* to the top portion 316*b* of a second leg 302*b* adjacent to the first leg 302*a*. A second cross brace 312*b* can be used to connect the top portion 316*a* of the first leg 302*a* to the bottom portion 314*b* of the second leg 302*b*. Each leg 302*a* can be braced against at least one other leg 302*b*. Preferably, each leg 302*a* can be braced against at least two other legs 302*b*, 302*c*. In some embodiments, a leg 302*a* can be braced against more than two other legs 302*b*, 302*c*.

Preferably, the legs 302 can comprise schedule-40 pipe made up of plastic, steel, aluminum, and the like. Wood, wood composites, rubber, and other structurally durable material can be used.

Each leg 302 can further comprise a foot 304. The foot 304 may have a larger cross-sectional dimension than the leg 302 to increase stability of the leg 302 mounted on the foot 304. The foot 304 can be connected to the leg 302 in a movable manner to allow the foot 304 to adjust the level. As such, the foot 304 can be a leveling foot. Preferably, the foot 304 allows the leg 302 to adjust its height. For example, the foot can screw into the bottom portion 314 of the leg 302. The ultimate height of the leg 302 can depend on how deep the foot 304 is screwed into the bottom portion 314 of the leg. In some embodiments, the foot 304 can be connected to the leg 302 via a universal joint, ball-and-socket joint, swiveling connection, telescopic connection, and the like to accommodate uneven ground surfaces.

In embodiments in which the leg 302 is attached to the base unit 204 via a floor beam 250, the leg 302 can have a slot 252 configured to receive the floor beam 250. Minimal number of fasteners 254 can be used to secure the legs 302 to the floor beams 250, the base unit 204, and the lock 223.

Surface Panels

FIGS. 7 and 9-11 illustrate the various features of the play surface 400 for facilitating playing the game, in accordance with some embodiments. The play surface 400 comprises a plurality of surface panels 402. The plurality of surface panels 402 can be configured to be removably attached on the top side 210 of the base unit 204, for example, using a tongue-and-groove screw-down court surface. Further, the plurality of surface panels 402 can be modularly connected to each other using snap-fit, resistance fit, tongue-and-groove, hooks, pegs, dowels, tracks, tabs, and the like. In general, the play surface 400 can be comprised of a contact layer 401 and a performance layer 403. The contact layer 401 can comprises layers that facilitate and endure the contact made on the play surface 400. The performance layer 403 comprises layers that improve the functionality of the play surface 400. For example, the contact layer may comprise an acrylic top coat 414. Underneath the acrylic top coat can be a non-compressive structural core 408. The performance layer 403 can add improved functionality by adding, for example, an ice melting device 450 to melt ice in cold weather, a sound absorption layer 452 to absorb sounds, and a water proof layer 247 to reduce or prevent potential water damage.

Because the playing court 118 is configured to be used outdoors, it must be able to withstand the various environmental conditions (hot, cold, humid, dry, etc.) as well as changing environmental conditions. Using vapor open materials allow for the movement of water vapor through them. Using vapor closed materials shuts down the movement of water vapor through them. Water vapor can move through a material using air flow, diffusion through material cavities, or diffusion through molecular bonds. A vapor stable assembly can only have one vapor closed layer. All other layers should allow outward movement of vapor to allow vapor to escape and prevent damage to the assembly. Two or more materials with a vapor closed characteristic in direct contact are considered the same vapor closed layer. The vapor characteristics of the layers allow for watertight and waterproof materials for the playing court 118. These features are important design requirements in order to use mass-timber and wood sandwich materials as a replacement for concrete, stone, or asphalt foundations. As such, it is important to use waterproof based wood materials that are surrounded by materials that are additionally waterproof or provide outward drying potential in order for these assemblies to act in a drying manner rather than aggregate water that would lead to failure.

Figure 9:
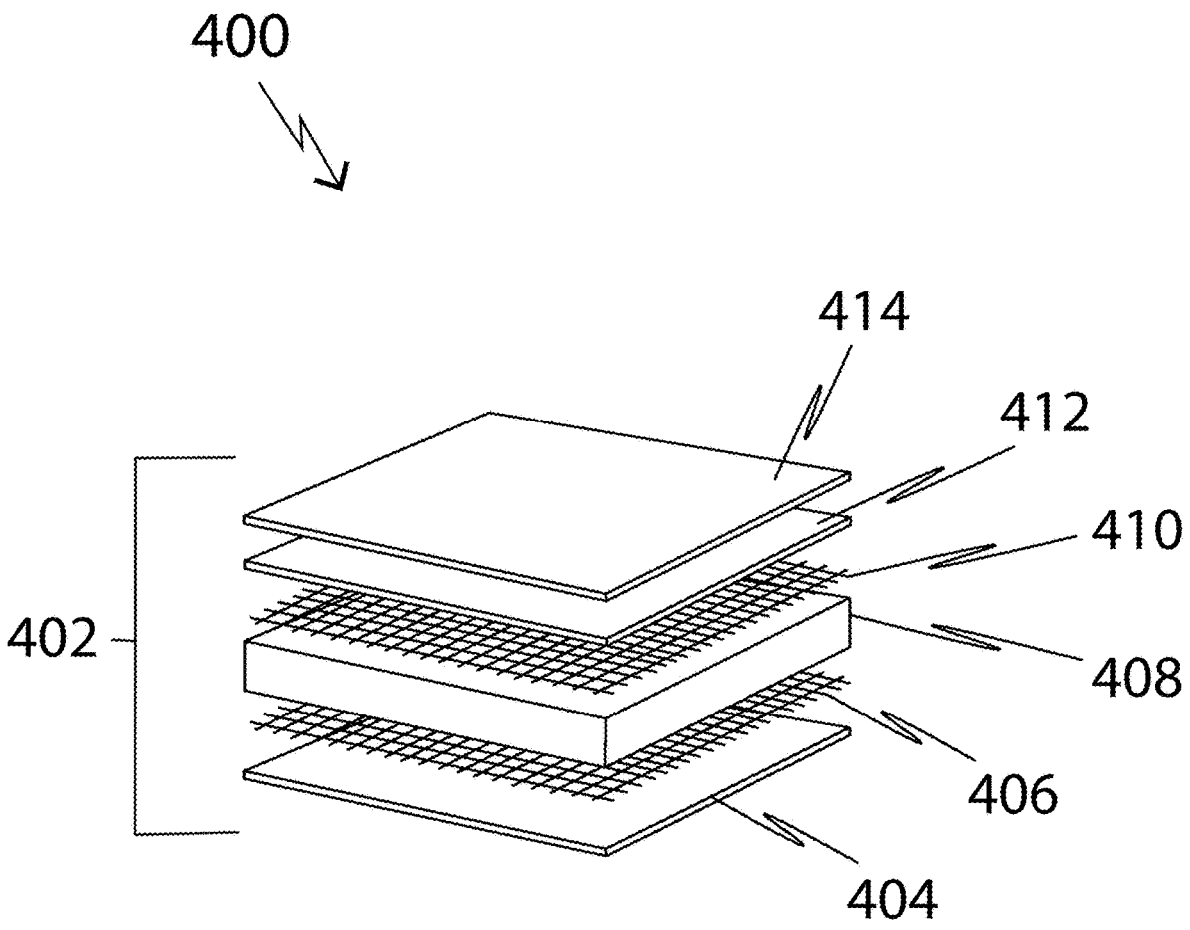
FIG. 9 is an exploded view of the layers of the play surface, in accordance with some embodiments.

As shown in FIG. 9, each surface panel 402 may comprise one or more of the following layers: a first vapor open coat 404, a first reinforcing mesh 406, a vapor open non-compressive structural core 408, a second reinforcing mesh 410, a second vapor open coat 412, and a vapor open sanded acrylic top coat 414. Preferably, the formation of the layers of the surface panel 402, or a portion of the layers, can be symmetrical to prevent warping and even movement of water through the surface panel 402. As such, the outer most layers (e.g. the top layer and the bottom layer) may be of the same or very similar material to handle transmission of water or water vapors similarly. An intermediate layer can have a corresponding intermediate layer on the opposite side of a center layer (or pair of center layers). For example, as shown in FIG. 6, the vapor open non-compressive structural core 408 can be the center layer. Bilaterally arranged about the vapor open non-compressive structural core 408 can be a pair of reinforcing mesh layers 406, 410. On opposite sides of the mesh layers 406, 410 can be the vapor open coats 404, 412.

Preferably, the vapor open coat 404 is a vapor open hardening coating. For example, the vapor copen coat 404 can comprise cement, plaster, gypsum, and the like. In some embodiments, a first reinforcing mesh 406 can be disposed on top of the first vapor open coat 404. The first reinforcing mesh 406 may be disposed under tension. In some embodiments, a vapor open non-compressive structural core 408 can be disposed on top of the first reinforcing mesh 406. In some embodiments, a second reinforcing mesh 410 can be disposed on top of the vapor open non-compressive structural core 408. The second reinforcing mesh 410 may be disposed under compression. In some embodiments, a second vapor open coat 412 can be disposed on the second reinforcing mesh 410. Like the first vapor open coat 404, the second vapor open coat 412 can be a hardening layer.

Tension and compression can apply to on outer surfaces of all core structures. Therefore, all structural cores can have a top layer that is under compression (the downward force is causing the upper surface to compact), and a bottom layer that is under tension (downward force is causing the bottom layer to stretch). This is especially true with soft cores that act mostly to transfer the loads from the top layer to the bottom layer but do not provide much additional stiffness. Ribbing can be added to the core to provide additional stiffness as core materials become softer.

In the preferred embodiment, a vapor open sanded acrylic top coat 414 can be disposed on the second vapor open coat 412 for the actual playing surface. Preferably, there are three layers of the vapor open sanded acrylic top coats 414.

Figure 10:
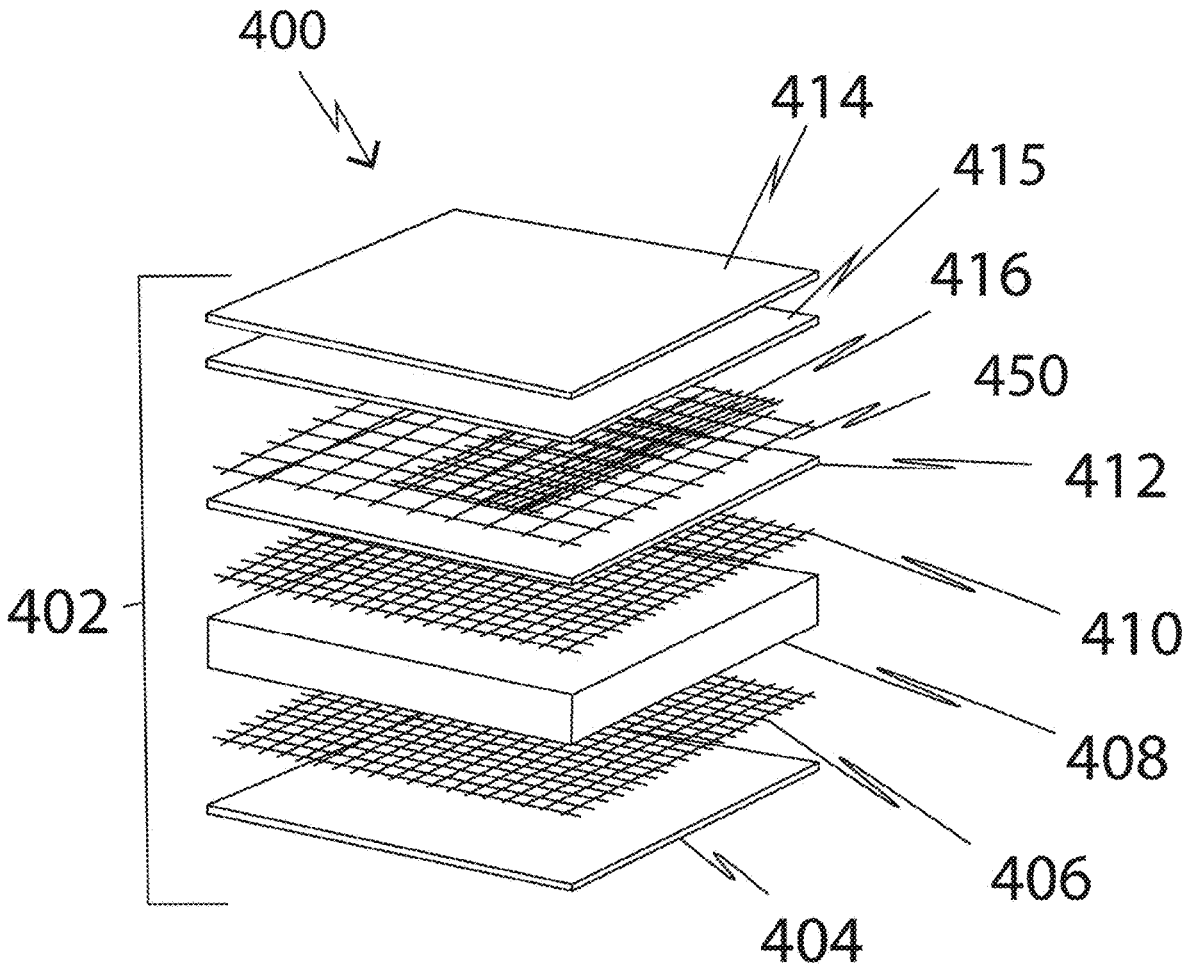
FIG. 10 is an exploded view of the layers of another embodiment of the play surface, in accordance with some embodiments.

As shown in FIG. 10, in some embodiments, the surface panels 402 for facilitating playing the game may further comprise a contact sensor grid 416 having a plurality of sensor dispersed throughout the grid. The contact sensor grid 416 creates a smart court with embedded sensors of adequate resolution to provide sensor detection of a sporting equipment, such as a ball, puck, shuttlecock, gear, and the like, that contacts the play surface 400. The sensors can be connected to a computing device 800 to collect contact data based on detecting a contact of the sporting equipment on the playing surface during a playing session of the game. Detection of surface contact at select locations (e.g. boundaries) can trigger a visual identification marker for the players and officials to use to determine the playability of the ball. In other words, the grid sensor can facilitate the determination of whether a play was in or out of bounds. This would eliminate all line call disagreements. The visual identification marker can be visualized on the play surface 400 or on a separate monitor.

The sensors can be mechanical sensors (to detect contact, force, and the like), light sensors (to detect lights, changes in light, motion, and the like), audible sensors (to detect sound), temperature sensors (to detect temperature or change in temperature), and the like, and any combination thereof. The contact sensor grid 416 can be placed underneath the vapor open sanded acrylic top coat 414. The contact sensor grid 416 and the vapor open sanded acrylic top coat 414 are configured such that the sensor grid can detect contact made on top of the vapor open sanded acrylic top coat 414. Preferably, the contact sensor grid 416 may be disposed on the second vapor open coat 412.

In the preferred embodiment, the contact sensor grid 416 is arranged with an asymmetric resolution so that regions of the play surface 400 that are not critical for determining exactly where contact was made has a lower resolution than areas of the play surface 400 where identifying exact contact points is critical, such as at the boundaries. Therefore, the density of sensors is higher near boundary lines than, for example, in the middle of the playing court 118. For example, with a contact sensor grid 416, moving along the grid perpendicularly towards a boundary line (e.g. side line or end line) results in a tighter grid with higher sensor resolution. As such, contact sensing near the boundary line by the ball, puck, athlete, and the like, is more precise near that boundary line. The contact sensor grid 416 moving parallel along a boundary line (e.g. side line), however, need not increase sensor resolution, until another boundary line is approached in a perpendicular manner (end line).

To provide for contact locations on the play surface 400, the surface panels 402 may further comprise a light source 415. For example, the light source 415 can be an LED array corresponding with the sensor grid 416 pattern. The light source 415 can be associated with the contact sensor grid 416 so that individual lights (e.g. LEDs) correspond with individual sensors 418, or groups of lights correspond with groups of sensors 418. As such, the sensor 418 that detects the contact can illuminate the corresponding light at the location of the sensor 418 to indicate where the contact took place. Such detection/illumination correspondence allows the players, officials, and audience members to see exactly where the contact on the play surface took place to determine whether the play was in bounds or out of bounds.

In some embodiments, an audible signal generator can be associated with the plurality of sensors 418 to generate an audible signal for identifying where the contact occurred on the playing surface 400. As such, audible signal generators can be placed at the location of the sensors so that when a sensor detects contact at the playing surface 400, the audible signal generator can sound at that location.

Figure 11:
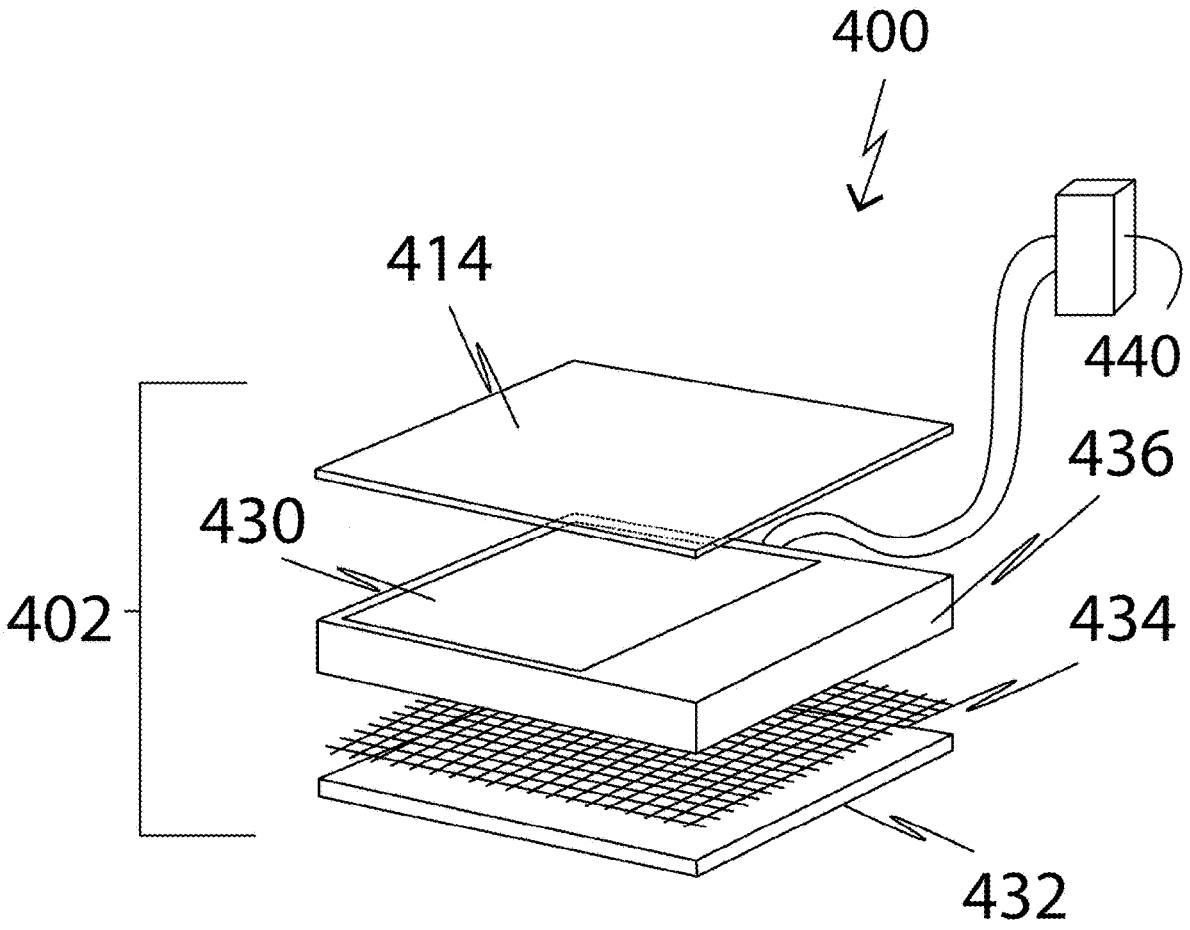
FIG. 11 is an exploded view of the layers of the play surface, in accordance with some embodiments.

With reference to FIG. 11, in some embodiments, the surface panels 402 can be configured for generating and/or harvesting electricity. For example, the play surface 400 can include one or more power generating devices 430 integrated with one or more of the surface panels 402 for generating and/or harvesting electrical power. Preferably, the power generating devices 430 can be devices that can be incorporated into one of the surface panels 402, such as photovoltaic panels, piezoelectric devices, and the like. Power generating devices 430 that can be incorporated into the surface panels 402 are preferred due to ease of installation and setup. However, other power generating devices 430 can also be used depending on the environment, such as wind turbines and hydroelectric turbines. Having power generating devices 430 integrated into the playing court allows for energy independent installation. As such, the power generating devices 430 can be operatively connected to any component of the playing court 118 that requires electricity or power. As such, the playing court 118 can be installed almost anywhere regardless of whether an external power source is present or not, and still be fully operational due to the ability of the playing court 118 to generate and/or harvest its own power and electricity. The power generating device 430 can be operatively connected to a rechargeable power source, such as a battery, for powering the electric devices in this invention. As such, the rechargeable power source may be configured for storing the electrical power, or powering the electric devices, such as the sensors 418, light arrays, communication device, ice melting mechanism 450, lighting system 700, and the like. A controller 440 can also be connected to the power generating device 430 to control how the energy is distributed or stored.

As shown in FIG. 11, in embodiments with power generating devices 430, the surface panel 402 may include a vapor closed base layer 432 upon which the power generating device 430 can be mounted. The vapor closed base layer 432 provides the structural support and protect electrical components from water. Preferably, the surface panels 402 may include a reinforcing bonding mesh layer 434 disposed on the vapor-closed base layer 432. In some embodiments, the plurality of surface panels 402 may include a vapor-closed non-compressive structural core 436 disposed on the reinforcing bonding mesh layer 434. In some embodiments, the power generating devices 430 (such as photovoltaic cells, piezoelectric devices, and the like) may be disposed on the vapor-closed non-compressive structural core 436. In some embodiments, an acrylic coat 438 can be placed on top of the power generating device 430. In some embodiments, in which the power generating device 430 is a photovoltaic cell, the acrylic coat 438 can be a clear acrylic coat, such as a clear acrylic top coat. For example, the clear acrylic may be include clear crushed glass sand to allow the sun to shine through and reach the photovoltaic cells. In some embodiments, only a portion of the acrylic coat 438 (i.e. the portion above the photovoltaic cell) needs to be clear acrylic. As such, portion of the acrylic coat 438 that would not block the sun's rays from reaching the photovoltaic cell can be other type of material, such as sanded acrylic paint. In some embodiments, the plurality of surface panels 402 may include a sanded acrylic paint layer disposed on the plurality of power generating devices 430. Further, the plurality of surface panels 402 may include an acrylic top coat disposed on the sanded acrylic paint layer.

Further, the playing court 118 may include a communication device communicatively coupled with the plurality of sensors and the plurality of light sources. The communication device may be configured for receiving the at least one ball contact data from the plurality of sensors and transmitting the indication to the plurality of light sources.

The playing court 118 may further include a computing or processing device 800 communicatively coupled with the communication device 440. The processing device 800 may be configured for analyzing the at least one ball contact data. The processing device 800 may be configured for generating at least one ball contact information associated with the contact of the ball. The processing device 800 may be further configured for determining a ball playability based on the at least one ball contact information and at least one game information associated with the game. The processing device 800 may be further configured for generating the indication based on the determining of the ball playability.

In some embodiments, the communication device 440 may be configured for sending and receiving the at least one game information from at least one other computing device 818, such as a user device associated with at least one user. Further, the at least one other computing device 818 may include a smartphone, a tablet, a laptop, etc. Further, the at least one user may include an umpire, a referee, a coach, a player, etc.

Further, in some embodiments, the communication device 440 may be configured for transmitting the ball playability to the at least one other computing device 818. Further, the ball playability may indicate whether the ball is out or in of a playing court associated with the game.

In some embodiments, the plurality of surface panels 402 may include an ice melting mechanism 450, such as a heater, heating filament, radiant coils, and the like. In the preferred embodiment, the ice melting mechanism 450 can be electrically coupled to the plurality of power generating devices 430. As such, the plurality of power generating devices 430 can be configured for powering the ice melting mechanism 450. Further, the ice melting mechanism 450 may be configured for generating heat. Further, the heat may melt any snow or ice present on the base assembly 200.

Net Assembly

Further, the playing court 118 may include a net assembly 500 configured to be removably attached to the base assembly 200. Further, the playing court apparatus may include integrated net system slots into receivers in the court for minimalistic design. For example, the top-side holes 226 on the base assembly 200 can be used to receive net posts 502 that hold up the net 504. The net posts 502 can be telescoping posts to adjust the height of the net 504. As such, the net 504 can be placed at ground level for sports such as tennis, pickleball, and the like. In addition, the net 504 can be raised off the ground for sports such as badminton, volleyball, and the like. Alternatively, the playing court 118 can come with a variety of different posts and nets for the different sports.

Fencing System

The playing court 118 may include a fencing assembly 600 configured to be removably coupled with the base assembly 200. The fencing assembly 600 may be disposed around a periphery of the base assembly 200 to prevent unauthorized, unintended, or unexpected entry onto the playing court 118. The fencing assembly 600 can comprise a plurality of fence posts 602, such as a standard steel fence post, and fencing 604 attachable to the fence posts 602, such as chain link fence, wood fence, metal fence, vinyl fence, fence panels, and the like. The base assembly 200 may include dedicated fencing post holes when the cells continue. In some embodiments, the top-side holes 226 can be used to receive the fence post 602.

Lighting System

Inadequate court lighting creates dark areas on the playing surface that leads to increased injury. As such, the playing court 118 may include a lighting assembly 700 configured to be removably coupled with the base assembly 200 in at least one location along the periphery of the base assembly 200. The lighting assembly 700 comprises one or more lighting devices 702, such as lamps, spotlights, lanterns, bulbs, LEDs, and the like. In some embodiments, the lighting device 702 of the lighting assembly 700 may be electrically coupled to a power source 704. The power source 704 may be configured for powering the lighting device 702. The playing court 118 provides an optimal lighting solution with options to be plugged into a regular household outlet, connected to an electric car, or run via a battery pack that can be charged with the power generating device 430, such as a solar panel, that is integrated into the playing surface 400.

Manufacturing

Figure 12:
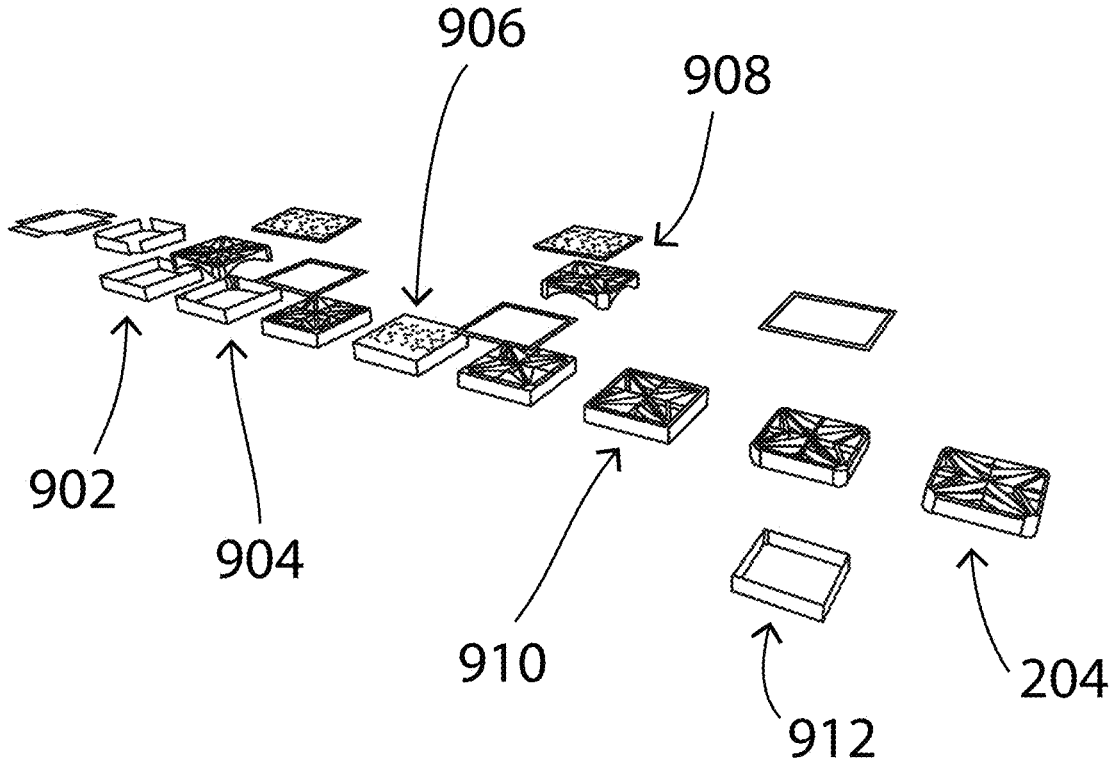
FIG. 12 illustrates a method for producing a base assembly insulated structural cell for facilitating playing the game, in accordance with some embodiments.

FIG. 12 illustrates a method for producing a base assembly 200 insulated structural cell for facilitating playing the game, in accordance with some embodiments. Accordingly, the method may include inserting a packaging sleeve 802 into an outer form. Further, the method may include installing a positive mold component 804 and top of form with injection holes. Further, the method may include injecting a sound insulation component into a negative mold space 806. Further, the method may include removing the positive mold 808. Further, the method may include casting a remaining space with a structural component 810. Further, the method may include removing the outer form leaving a sound insulated structural cell in the final packaging 812.

Figure 13:
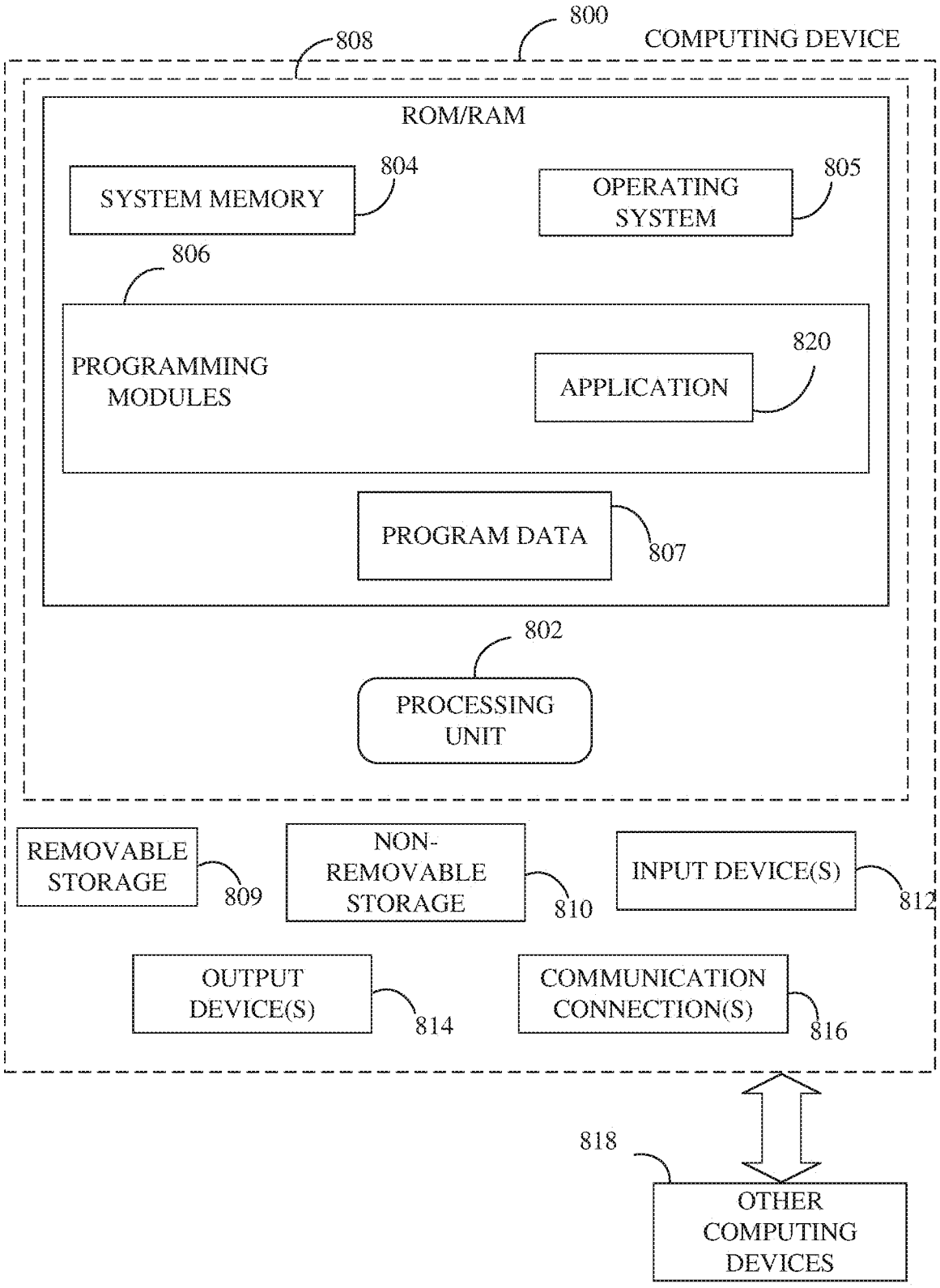
FIG. 13 is a block diagram of a computing device for implementing the methods disclosed herein, in accordance with some embodiments.

With reference to FIG. 13, a system consistent with an embodiment of the disclosure may include a computing device or cloud service, such as computing device 800. In a basic configuration, computing device 800 may include at least one processing unit 802 and a system memory 804. Depending on the configuration and type of computing device, system memory 804 may comprise, but is not limited to, volatile (e.g. random-access memory (RAM)), non-volatile (e.g. read-only memory (ROM)), flash memory, or any combination. System memory 804 may include operating system 805, one or more programming modules 806, and may include a program data 807. Operating system 805, for example, may be suitable for controlling the operation of the computing device 800. In some embodiments, programming modules 806 may include image-processing module, machine learning module and/or image classifying module. Furthermore, embodiments of the disclosure may be practiced in conjunction with a graphics library, other operating systems, or any other application program and is not limited to any particular application or system. This basic configuration is illustrated in FIG. 8 by those components within a dashed line 808.

The computing device 800 may have additional features or functionality. For example, the computing device 800 may also include additional data storage devices (removable and/or non-removable) such as, for example, magnetic disks, optical disks, or tape. Such additional storage is illustrated in FIG. 8 by a removable storage 809 and a non-removable storage 810. Computer storage media may include volatile and nonvolatile, removable and non-removable media implemented in any method or technology for storage of information, such as computer-readable instructions, data structures, program modules, or other data. The system memory 804, removable storage 809, and non-removable storage 810 are all computer storage media examples (i.e., memory storage.) Computer storage media may include, but is not limited to, RAM, ROM, electrically erasable read-only memory (EEPROM), flash memory or other memory technology, CD-ROM, digital versatile disks (DVD) or other optical storage, magnetic cassettes, magnetic tape, magnetic disk storage or other magnetic storage devices, or any other medium which can be used to store information and which can be accessed by computing device 800. Any such computer storage media may be part of device 800. Computing device 800 may also have input device(s) 812 such as a keyboard, a mouse, a pen, a sound input device, a touch input device, a location sensor, a camera, a biometric sensor, etc. Output device(s) 814 such as a display, speakers, a printer, etc. may also be included. The aforementioned devices are examples and others may be used.

The computing device 800 may also contain a communication connection 816 that may allow device 800 to communicate with other computing devices 818, such as over a network in a distributed computing environment, for example, an intranet or the Internet. Communication connection 816 is one example of communication media. Communication media may typically be embodied by computer-readable instructions, data structures, program modules, or other data in a modulated data signal, such as a carrier wave or other transport mechanism, and includes any information delivery media. The term "modulated data signal" may describe a signal that has one or more characteristics set or changed in such a manner as to encode information in the signal. By way of example, and not limitation, communication media may include wired media such as a wired network or direct-wired connection, and wireless media such as acoustic, radio frequency (RF), infrared, and other wireless media. The term computer-readable media as used herein may include both storage media and communication media.

As stated above, a number of program modules and data files may be stored in system memory 804, including operating system 805. While executing the processing unit 802, programming modules 806 (e.g., application 820 such as a media player) may perform processes including, for example, one or more stages of methods, algorithms, systems, applications, servers, databases as described above. The aforementioned process is an example, and processing unit 802 may perform other processes. Other programming modules that may be used in accordance with embodiments of the present disclosure may include sound encoding/decoding applications, machine learning application, acoustic classifiers, etc.

Generally, consistent with embodiments of the disclosure, program modules may include routines, programs, components, data structures, and other types of structures that may perform particular tasks or that may implement particular abstract data types. Moreover, embodiments of the disclosure may be practiced with other computer system configurations, including hand-held devices, general-purpose graphics processor-based systems, multiprocessor systems, microprocessor-based or programmable consumer electronics, application-specific integrated circuit-based electronics, minicomputers, mainframe computers, and the like. Embodiments of the disclosure may also be practiced in distributed computing environments where tasks are performed by remote processing devices that are linked through a communications network. In a distributed computing environment, program modules may be located in both local and remote memory storage devices.

Furthermore, embodiments of the disclosure may be practiced in an electrical circuit comprising discrete electronic elements, packaged or integrated electronic chips containing logic gates, a circuit utilizing a microprocessor, or on a single chip containing electronic elements or microprocessors. Embodiments of the disclosure may also be practiced using other technologies capable of performing logical operations such as, for example, AND, OR, and NOT, including but not limited to mechanical, optical, fluidic, and quantum technologies. In addition, embodiments of the disclosure may be practiced within a general-purpose computer or in any other circuits or systems.

Embodiments of the disclosure, for example, may be implemented as a computer process (method), a computing system, or as an article of manufacture, such as a computer program product or computer-readable media. The computer program product may be a computer storage media readable by a computer system and encoding a computer program of instructions for executing a computer process. The computer program product may also be a propagated signal on a carrier readable by a computing system and encoding a computer program of instructions for executing a computer process. Accordingly, the present disclosure may be embodied in hardware and/or in software (including firmware, resident software, micro-code, etc.). In other words, embodiments of the present disclosure may take the form of a computer program product on a computer-usable or computer-readable storage medium having computer-usable or computer-readable program code embodied in the medium for use by or in connection with an instruction execution system. A computer-usable or computer-readable medium may be any medium that can contain, store, communicate, propagate, or transport the program for use by or in connection with the instruction execution system, apparatus, or device.

The computer-usable or computer-readable medium may be, for example but not limited to, an electronic, magnetic, optical, electromagnetic, infrared, or semiconductor system, apparatus, device, or propagation medium. More specific computer-readable medium examples (a non-exhaustive list), the computer-readable medium may include the following: an electrical connection having one or more wires, a portable computer diskette, a random-access memory (RAM), a read-only memory (ROM), an erasable programmable read-only memory (EPROM or Flash memory), an optical fiber, and a portable compact disc read-only memory (CD-ROM). Note that the computer-usable or computer-readable medium could even be paper or another suitable medium upon which the program is printed, as the program can be electronically captured, via, for instance, optical scanning of the paper or other medium, then compiled, interpreted, or otherwise processed in a suitable manner, if necessary, and then stored in a computer memory.

Embodiments of the present disclosure, for example, are described above with reference to block diagrams and/or operational illustrations of methods, systems, and computer program products according to embodiments of the disclosure. The functions/acts noted in the blocks may occur out of the order as shown in any flowchart. For example, two blocks shown in succession may in fact be executed substantially concurrently or the blocks may sometimes be executed in the reverse order, depending upon the functionality/acts involved.

While certain embodiments of the disclosure have been described, other embodiments may exist. Furthermore, although embodiments of the present disclosure have been described as being associated with data stored in memory and other storage mediums, data can also be stored on or read from other types of computer-readable media, such as secondary storage devices, like hard disks, solid-state storage (e.g., USB drive), or a CD-ROM, a carrier wave from the Internet, or other forms of RAM or ROM. Further, the disclosed methods' stages may be modified in any manner, including by reordering stages and/or inserting or deleting stages, without departing from the disclosure.

In use, assembly can be done by one person or a small team with no large equipment. Each cell is designed to be light enough for one person to carry and install. A level line is set to establish proper install slope. The first row of cells are placed, along with their supporting feet, to align with the level line. The cells are installed starting in one corner and setting the first row across the short side of the court. Then setting each new row starting on the side of the initial cell. Cell parts are assembled and secured in place as each new row is set to be flush with the established level line. Adjustment to pier footing height is made along each row to maintain the level of the top surface. Connections between components are made with a screwdriver through guide holes provided. Once all the cells are installed, prefabricated perimeter fencing posts are installed into provided receptacles in the cell surface and secured together at joints. Lights are then installed into provided receptacles in the cell surface. Play net is then installed into provided receptacles in the cell surface.

Although the invention has been explained in relation to its preferred embodiment, it is to be understood that many other possible modifications and variations can be made without departing from the spirit and scope of the invention.

The invention claimed is:

1. A modular sport court, comprising:

a) a base assembly configured to be disposed on at least one ground surface, b) a leveling foundation to hold the base assembly;

c) a play surface mounted on top of the base assembly;

d) a net system operatively connected to the play surface;

e) a fencing system operatively connected to a perimeter of the base assembly;

f) a lighting system operatively connected to the base assembly to provide lighting to the play surface, g) wherein the base assembly comprises a plurality of base units, wherein each base unit comprises:

i) a top side and a bottom side opposite the top side, and a plurality of sidewalls, each sidewall comprising a connector configured to connect adjacent base units together, ii) a structural core having a top surface and a bottom surface opposite the top surface, wherein the structural core has a first reinforced layer on the top surface, and a second reinforced layer on the bottom surfaces, iii) a first water proof layer attached to the bottom surface of the structural core, iv) a second water proof layer attached to the top surface of the structural core, v) a sound insulating layer attached to the first water proof layer opposite the structural core, vi) a lock to align adjacent base units and create a continuous top surface of the structural core, vii) a top side hole for receiving the fencing system and a bottom side hole for receiving the leveling foundation, wherein the top side hole and bottom side hole are formed by two or more base units viii) a plurality of ribbing extending radially away from the top side hole and the bottom side hole and to the plurality of sidewalls;

h) wherein the leveling foundation comprises:

i) a leg, ii) a leveling foot operatively connected to the leg, and iii) cross bracing connecting adjacent legs;

i) wherein the play surface comprises a plurality of surface panels, wherein each surface panel comprises any one or more of the following layers:

i) a first vapor open coat, ii) a first reinforcing mesh on top of the first vapor open coat, iii) a vapor open non-compressive structural core on top of the first reinforcing mesh, iv) a second reinforcing mesh on top of the vapor open non-compressive structural core, v) a second vapor open coat on top of the second reinforcing mesh, and vi) a vapor open sanded acrylic top coat on top of the second vapor open coat; and j) wherein the play surface further comprises:

i) a contact sensor grid having a plurality of sensors dispersed throughout the grid, wherein the contact sensor grid is arranged with an asymmetric resolution, ii) a light array corresponding with a pattern of the contact sensor grid, iii) a power generating devices for generating or harvesting electrical power, iv) an ice melting mechanism, and v) a controller connected to the power generating device to control distribution of the electrical power.

2. A modular sport court, comprising: a base assembly configured to be disposed on at least one ground surface, wherein the base assembly comprises a plurality of base units, wherein each base unit comprises:

a) a top side and a bottom side opposite the top side, and a plurality of sidewalls, each sidewall comprising a connector configured to connect adjacent base units together;

b) a structural core having a top surface and a bottom surface opposite the top surface;

c) a lock to align adjacent base units and create a continuous top surface of the structural core;

d) a top side hole and a bottom side hole opposite the top side hole; and e) a plurality of ribbing extending radially away from the top side hole and the bottom side hole and to the plurality of sidewalls.

3. The modular sport court of claim 2, wherein the structural core comprises a first reinforced layer on the top surface, and a second reinforced layer on the bottom surface.

4. The modular sport court of claim 2, wherein the base unit comprises a first water proof layer attached to the bottom surface of the structural core.

5. The modular sport court of claim 4, wherein the base unit comprises a second water proof layer attached to the top surface of the structural core.

6. The modular sport court of claim 2, wherein the base unit comprises a sound insulating layer underneath the structural core.

7. The modular sport court of claim 2, wherein a sound insulating material is integrated with the structural core.

8. The modular sport court of claim 2, further comprising a leveling foundation, wherein the leveling foundation comprises:

a) a leg;

b) a leveling foot operatively connected to the leg; and c) cross bracing to connect adjacent legs.

9. The modular sport court of claim 8, wherein the base unit comprises a bottom side hole for receiving legs of the leveling foundation.

10. The modular sport court of claim 2, further comprising a fencing system operatively connected to a perimeter of the base assembly.

11. The modular sport court of claim 2, further comprising a lighting system operatively connected to the base assembly to provide lighting.

12. The modular sport court of claim 2, further comprising a play surface mounted on top of the plurality of base units, the play surface comprising a plurality of surface panels.

13. The modular sport court of claim 12, further comprising a net system operatively connected to the play surface.

14. The modular sport court of claim 12, wherein each surface panel comprises any one or more of the following layers:

a) a first vapor open coat, b) a first reinforcing mesh on top of the first vapor open coat, c) a vapor open non-compressive structural core on top of the first reinforcing mesh, d) a second reinforcing mesh on top of the vapor open non-compressive structural core, e) a second vapor open coat on top of the second reinforcing mesh, and f) a vapor open sanded acrylic top coat on top of the second vapor open coat.

15. The modular sport court of claim 14, wherein the play surface further comprises:

a) a contact sensor grid having a plurality of sensors dispersed throughout the grid, wherein the contact sensor grid is arranged with an asymmetric resolution;

b) a light array corresponding with a pattern of the contact sensor grid;

c) a power generating devices for generating or harvesting electrical power; and d) an ice melting mechanism.

16. The modular sport court of claim 15, further comprising a controller connected to the power generating device to control distribution of the electrical power.

17. The modular sport court of claim 14, wherein the play surface comprises:

a) a power generating devices for generating or harvesting electrical power; and b) a contact sensor grid having a plurality of sensors dispersed throughout the grid.

18. The modular sport court of claim 17, wherein the contact sensor grid is arranged with an asymmetric resolution.

19. The modular sport court of claim 18, wherein the play surface further comprises a light array corresponding with a pattern of the contact sensor grid.

20. The modular sport court of claim 14, wherein the play surface comprises an ice melting mechanism.

* * * * *